US006685859B2

(12) United States Patent
Howell et al.

(10) Patent No.: US 6,685,859 B2
(45) Date of Patent: Feb. 3, 2004

(54) PROCESSES FOR MAKING POLY (TRIMETHYLENE TEREPHTHALATE) YARN

(75) Inventors: James M. Howell, Greenville, NC (US); Joe Forrest London, Jr., Greenville, NC (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 118 days.

(21) Appl. No.: 09/796,785

(22) Filed: Mar. 1, 2001

(65) Prior Publication Data

US 2001/0033929 A1 Oct. 25, 2001

Related U.S. Application Data

(60) Provisional application No. 60/187,244, filed on Mar. 3, 2000.

(51) Int. Cl.[7] ..... D01D 5/253; D01F 6/62; D02G 3/02

(52) U.S. Cl. ..... 264/103; 264/177.13

(58) Field of Search ..... 264/103, 177.13, 264/210.8

(56) References Cited

U.S. PATENT DOCUMENTS

| | | | |
|---|---|---|---|
| 3,350,871 | A | 11/1967 | Pierce et al. |
| 3,584,103 | A | 6/1971 | Harris |
| 3,671,379 | A | 6/1972 | Evans et al. |
| 3,681,188 | A | 8/1972 | Harris |

(List continued on next page.)

FOREIGN PATENT DOCUMENTS

| | | | |
|---|---|---|---|
| EP | 0 049 412 | B1 | 4/1985 |
| EP | 0 745 711 | A1 | 12/1996 |
| EP | 1 016 692 | A1 | 7/2000 |
| EP | 1 016 741 | A1 | 7/2000 |
| EP | 1 033 422 | A1 | 9/2000 |
| EP | 1 052 325 | A1 | 11/2000 |
| GB | 1075689 | | 7/1967 |
| GB | 1165312 | | 9/1969 |
| GB | 1254826 | | 11/1971 |

(List continued on next page.)

OTHER PUBLICATIONS

International Search Report from Counterpart PCT/US 01/06566 (Mailed Aug. 6, 2001).
English Abstract of JP 11–302922 A (Nov. 2, 1999).
H. L. Traub, "Synthese und textilchemische Eigenschaften des Poly–Trimethyleneterephthalats", *Dissertaion Universitat Stuttgart*, (1994) (English Translation).
Katsuhiko et al., "Elastic Moduli of Poly(trimethylene terephthalate) in the Crystalline Region", *Zairyo (Material)*, 35, No. 396, 106–110, (1986).
H. L. Traub et al., "Mechanical Properties of Fibers Made of Polytrimethylene Terephthalate", *Chemical Fibers International (CFI)*, 45, 110–111, (1995).
H. L. Traub, Dyeing Properties of Poly(Trimethylenene Terephthalate) Fibres, *Melliand*, (1995).
Degussa Trade Literature (Estimated 1994).
W. Oppermann et al., Fibers Made of Poly(trimethylene terephthalate), Dornbirn, (1995).
U.S. patent application No. 09/503,599, filed Feb. 11, 2000(Docket #RD7585).

*Primary Examiner*—Leo B. Tentoni
(74) *Attorney, Agent, or Firm*—Nancy S. Mayer; Mark D. Kuller

(57) ABSTRACT

Processes for making poly(trimethyelene terephthalate) yarn are provided. The process includes extruding a polyester polymer through a spinneret to form non-round filaments at a spinning speed less than 4500 mpm and a temperature between about 255° C. and about 275° C. The polyester polymer composition includes at least 85 mole percent poly(trimethylene terephthalate) wherein at least 85 mole percent of the repeating units consist of trimethylene units, and the polyester polymer has an intrinsic viscosity of at least 0.70 dl/g.

16 Claims, 4 Drawing Sheets

U.S. PATENT DOCUMENTS

| | | | |
|---|---|---|---|
| 3,816,486 | A | 6/1974 | Vail |
| 3,984,600 | A | 10/1976 | Kawase et al. |
| 4,385,886 | A | 5/1983 | Samuelson |
| 4,475,330 | A | 10/1984 | Kimura et al. |
| 4,850,847 | A | 7/1989 | Samuelson |
| 4,956,237 | A | 9/1990 | Samuelson |
| 5,250,245 | A | 2/1993 | Collins et al. |
| 5,340,909 | A | 8/1994 | Doerr et al. |
| 5,645,782 | A | 7/1997 | Howell et al. |
| 5,662,980 | A | 9/1997 | Howell et al. |
| 5,782,935 | A | 7/1998 | Hirt et al. |
| 5,885,909 | A | 3/1999 | Rudisill et al. |
| 5,968,649 | A | 10/1999 | Aneja |
| 6,023,926 | A | 2/2000 | Flynn |
| 6,033,777 | A | 3/2000 | Best |
| 6,066,714 | A | 5/2000 | Putzig et al. |
| 6,071,612 | A | 6/2000 | Roderiguez et al. |
| 6,109,015 | A | 8/2000 | Roark et al. |
| 6,245,844 | B1 | 6/2001 | Kurian et al. |
| 6,255,442 | B1 | 7/2001 | Kurian et al. |
| 6,284,370 | B1 | 9/2001 | Fujimoto et al. |
| 6,287,688 | B1 | 9/2001 | Howell et al. |
| 6,350,895 | B1 | 2/2002 | Kurian |
| 6,353,062 | B1 | 3/2002 | Giardino et al. |
| 6,383,632 | B2 | 5/2002 | Howell et al. |
| 6,482,484 | B1 | 11/2002 | Brown |
| 6,538,076 | B2 | 3/2003 | Giardino et al. |
| 6,576,340 | B1 | 6/2003 | Sun et al. |
| 2001/0030377 | A1 | 10/2001 | Howell et al. |
| 2002/0116802 | A1 | 8/2002 | Moerman et al. |

FOREIGN PATENT DOCUMENTS

| | | | |
|---|---|---|---|
| GB | 1408094 | | 10/1975 |
| JP | 52-8123 | | 7/1975 |
| JP | 52-8124 | | 7/1975 |
| JP | 57-193534 | | 4/1981 |
| JP | 58-81616 | | 11/1981 |
| JP | 58-104216 | | 12/1981 |
| JP | 57-61716 | | 4/1982 |
| JP | 5-71013 | A | 3/1993 |
| JP | 8-232117 | A | 2/1995 |
| JP | 8-311177 | A | 5/1995 |
| JP | 9-78373 | A | 9/1995 |
| JP | 11-12824 | A | 1/1999 |
| JP | 11-302922 | A | 2/1999 |
| JP | 11-93026 | A | 4/1999 |
| JP | 11-93031 | A | 4/1999 |
| JP | 11-93049 | A | 4/1999 |
| JP | 11-100721 | A | 4/1999 |
| JP | 11-107036 | A | 4/1999 |
| JP | 11-107038 | A | 4/1999 |
| JP | 11-107081 | A | 4/1999 |
| JP | 11-107154 | A | 4/1999 |
| JP | 11-158747 | A | 6/1999 |
| JP | 11-172526 | A | 6/1999 |
| JP | 11-172536 | A | 6/1999 |
| JP | 11-181626 | A | 7/1999 |
| JP | 11-181650 | A | 7/1999 |
| JP | 11-189920 | A | 7/1999 |
| JP | 11-200143 | A | 7/1999 |
| JP | 11-200175 | A | 7/1999 |
| JP | 11-229276 | A | 8/1999 |
| JP | 11-93036 | A | 9/1999 |
| JP | 11-93037 | A | 9/1999 |
| JP | 11-93038 | A | 9/1999 |
| JP | 2000-248439 | A | 9/2000 |
| KR | 1998-049300 | A | 9/1998 |
| WO | WO 98/23662 | A2 | 6/1998 |
| WO | WO 99/54040 | A1 | 10/1999 |
| WO | WO 00/39374 | | 12/1999 |
| WO | WO 00/22210 | | 4/2000 |
| WO | WO 00/26301 | A1 | 5/2000 |
| WO | WO 00/29653 | | 5/2000 |

PROCESSES FOR MAKING POLY (TRIMETHYLENE TEREPHTHALATE) YARN

PRIORITY

This application claims priority from U.S. Provisional Patent Application Ser. No. 60/187,244, filed Mar. 3, 2000, which is incorporated herein by reference.

BACKGROUND

1. Field of the Invention

The present invention relates to polyester yarn made from poly(trimethylene terephthalate) fibers. More particularly, the present invention relates to poly(trimethylene terephthalate) yarns fully oriented during the spinning process.

2. Background of the Invention

Synthetic fibers, such as polyester fibers, are well known in the textile industry for use in fabrics and garments. Such synthetic yarns are commonly made from polyethylene terephthalate fibers using known commercial processes. More recently, synthetic yarns from poly(trimethylene terephthalate) fibers are of interest. Because the two polymers have different properties, the base of knowledge related to spinning and drawing polyethylene terephthalate yarns is not directly applicable to poly(trimethylene terephthalate) yarns. However, the properties desirable in the end-product, i.e., the textile yarn or fabric, are often similar.

A "textile yarn" must have certain properties, such as sufficiently high modulus and yield point, and sufficiently low shrinkage, so as to be suitable for use in textile processes, such as texturing, weaving and knitting. Feeder yarns, on the other hand, require further processing before they have the minimum properties for processing into textiles. Feeder yarns (also referred to as "feed yarns" herein) are typically prepared by melt-spinning partially oriented yarn filaments which are then drawn and heated to reduce shrinkage and to increase modulus.

Feed yarns do not have the properties required to make textile products without further drawing. The drawing process imparts higher orientation in the yarn filaments and imparts properties important for textile applications. One such property, boil off shrinkage ("BOS"), indicates the amount of shrinkage the yarn exhibits when exposed to high temperatures. Because feed yarns require additional processing, however, production throughput is low and production costs are high. Existing commercially available partially-oriented poly(trimethylene terephthalate) yarns are drawn or draw-textured before use in fabrics. It is therefore desirable to provide a "direct-use" spun yarn which may be used to make textile products without further drawing.

The present invention provides direct-use poly (trimethylene terephthalate) yarns that are fully oriented spun yarns which may be used in textile fabrics without drawing or annealing, i.e., heat-setting.

SUMMARY OF THE INVENTION

The present invention comprises a process for spinning a direct-use yarn, comprising extruding a polyester polymer through a spinneret to form non-round filaments at a spinning speed less than 4500 mpm and a temperature between about 255° C. and about 275° C., wherein said polymer comprises at least 85 mole % poly(trimethylene terephthalate) wherein at least 85 mole % of repeating units consist of trimethylene units, and wherein said polymer has an intrinsic viscosity of at least 0.70 dl/g. Preferably, the spinning temperature is about 260° C.–about 270° C.

Preferably, the direct-use yarn is characterized by a boil off shrinkage of less than 15%.

Preferably, an individual filament in the plurality of non-round filaments is characterized by:

$$\text{a) } 0.5 \le \frac{A_1}{A_2} \le 0.95; \text{ and}$$

$$\text{b) } A_2 = \frac{P_1^2}{4\pi},$$

wherein $A_1$ is an area of a cross-section of the individual filament, $P_1$ is a perimeter of said cross-section of the individual filament, and $A_2$ is a maximum area of a cross-section having a perimeter $P_1$. In one preferred embodiment, $0.6 \leqq A_1/A_2 \leqq 0.95$. Preferably, at least 65% of the filaments of the yarn meet the conditions. More preferably, at least 70% of the filaments of the yarn meet the conditions. Even more preferably, at least 90% of the filaments of the yarn meet the conditions.

Preferably, on average the individual filaments in the yarn meet the conditions.

Preferably, the yarn filaments have deniers of 0.35 dpf–10 dpf. Preferably, the yarn has a denier of 20–300. Preferably, the poly(trimethylene terephthalate) has an IV of 0.8 dl/g–1.5 dl/g.

A direct-use yarn, is a yarn that is not drawn or annealed in a separate processing step.

The present invention also is directed to a direct-use yarn made from a polyester polymer melt-extruded at a spinning temperature between about 255° C. and about 275° C. and a spinning speed less than 4500 mpm, wherein said polymer comprises at least 85 mole % poly(trimethylene terephthalate) wherein at least 85 mole % of repeating units consist of trimethylene units, and wherein said polymer has an intrinsic viscosity of at least 0.70 dl/g, and wherein said direct-use yarn comprises a plurality of non-round filaments. Preferably, the spinning temperature is about 260° C.–about 270° C.

Preferably, the direct-use yarn is characterized by a boil off shrinkage of less than 15%.

Preferably, an individual filament in the plurality of non-round filaments is characterized by:

$$\text{a) } 0.5 \le \frac{A_1}{A_2} \le 0.95; \text{ and}$$

$$\text{b) } A_2 = \frac{P_1^2}{4\pi},$$

wherein $A_1$ is an area of a cross-section of the individual filament, $P_1$ is a perimeter of said cross-section of the individual filament, and $A_2$ is a maximum area of a cross-section having a perimeter $P_1$. In one preferred embodiment, $0.6 \leqq A_1/A_2 \leqq 0.95$. Preferably, at least 65% of the filaments of the yarn meet the conditions. More preferably, at least 70% of the filaments of the yarn meet the conditions. Even more preferably, at least 90% of the filaments of the yarn meet the conditions.

Preferably, on average the individual filaments in the yarn meet the conditions.

Preferably, the yarn filaments have deniers of 0.35 dpf–10 dpf. Preferably, the yarn has a denier of 20–300. Preferably, the poly(trimethylene terephthalate) has an IV of 0.8 dl/g–1.5 dl/g.

A direct-use yarn is a yarn that is not drawn or annealed in a separate processing step.

Preferably, at least 70% of the filaments of the yarn meet the conditions, the filaments of the yarn have deniers of 0.5 dpf to 7 dpf, the yarn has a denier of 30–200, and the direct-use yarn is characterized by a boil off shrinkage of less than 15%. More preferably, on average the individual filaments in the yarn meet the conditions and the poly (trimethylene terephthalate) has an IV of 0.8 dl/g–1.5 dl/g.

A direct-use yarn of has not and is not drawn or annealed.

The invention is further directed to process of preparing a fabric comprising:

(a) spinning a direct-use yarn as claimed in claim 1, and (b) weaving or knitting the yarn into a fabric.

In this process, the yarn is fully oriented during spinning and is not drawn or annealed to orient the yarn after spinning.

DETAILED DESCRIPTION OF THE INVENTION

Figure 1:
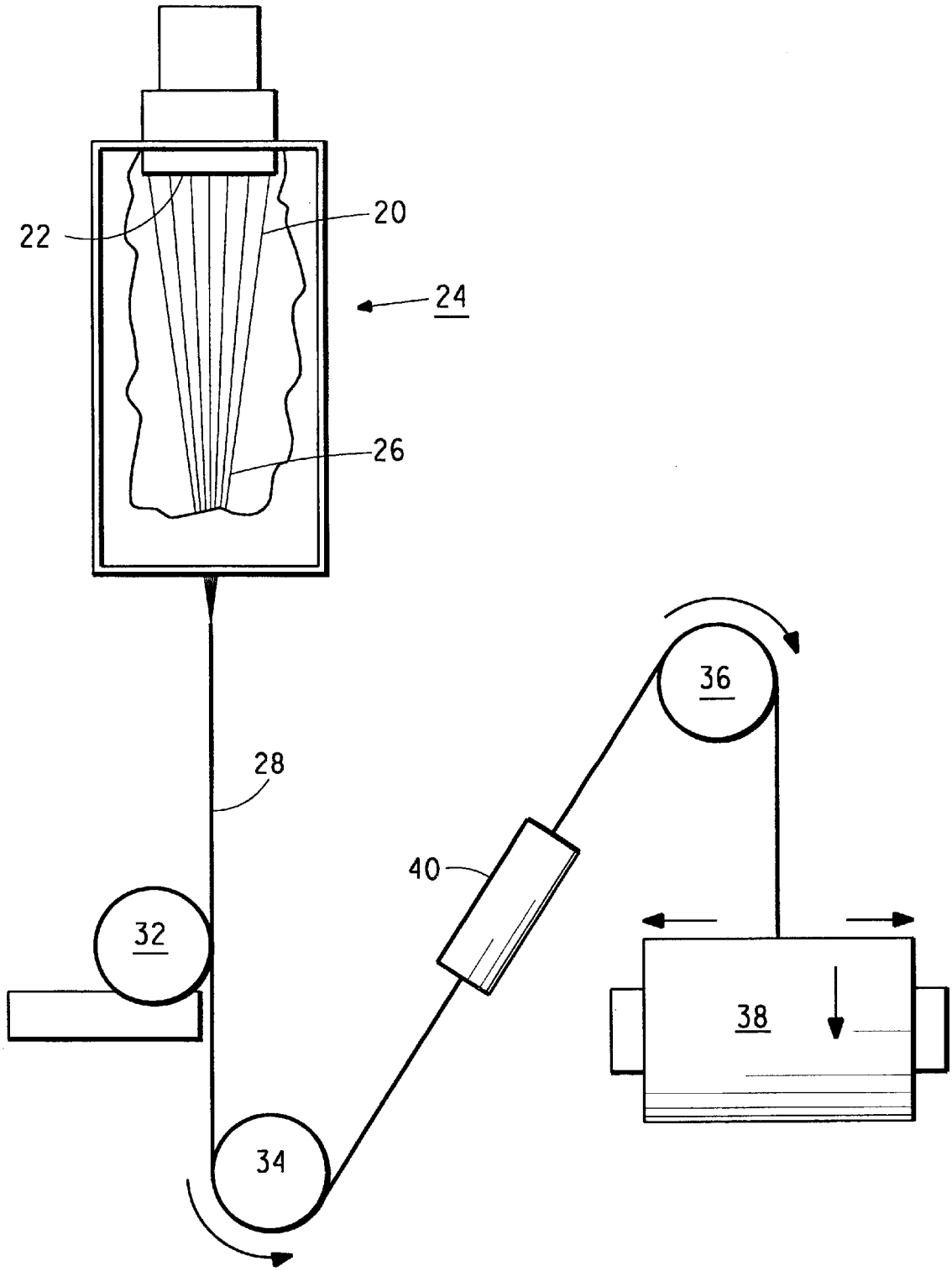
FIG. 1 is a schematic diagram of an exemplary spinning position for making the direct-use poly(trimethylene terephthalate) yarns of the present invention.

The present invention provides a method for spinning a fully oriented poly(trimethylene terephthalate) yarn suitable for direct-use in textile operations without intermediate drawing or texturing. The present invention further provides such direct-use poly(trimethylene terephthalate) yarns. The method of the present invention provides direct-use yarns spun at much lower spinning speeds than required in the past. Using the method of the present invention, a direct-use fully oriented poly(trimethylene terephthalate) yarn can be spun at less than 4500 meters per minute ("mpm"). Spin speeds can be as low as 3,000 mpm, or even slower, at commercial throughputs. The direct-use yarns of the present invention are characterized by having a boil off shrinkage less than 15% and are made from filaments having non-round cross-sections. (Some boil off shrinkage is desired for fabric processing. Boil off shrinkage as low as about 2% can be useful.)

It has been found that direct-use fully oriented poly (trimethylene terephthalate) yarns can be made using melt-spinning processes at a spinning speed lower than 4500 mpm if the cross-sectional shape of the yarn filaments are non-round. As used herein, a filament of non-round cross-section satisfies the following conditions:

$$0.5 \le \frac{A_1}{A_2} \le 0.95 \text{ and} \tag{I}$$

-continued $$A_2 = \frac{P_1^2}{4\pi}, \tag{II}$$

where $A_1$ is the actual cross-sectional area of the individual yarn filament, $P_1$ is the perimeter of the cross-section of the individual yarn filament, and $A_2$ is the maximum area of a cross-section having the same perimeter, $P_1$. According to this definition, for a perfectly round cross-section, the ratio of actual cross-sectional area to maximum cross-sectional area is exactly 1. The examples below show that if conditions (I) and (II) are satisfied, a lower spinning speed can be used to achieve the desired direct-use yarns.

One preferred embodiment is directed to non-rounds cross-sections with formula (I) meeting the following conditions $0.6 \leqq A_1/A_2 \leqq 0.95$.

Preferably at least 65%, more preferably 70%, and even more preferably at least 90%, or more, of the filaments of the yarn meet these conditions. Preferably, on average the individual filaments in the yarn meet the conditions.

The filaments of this invention can have deniers as lows as about 0.35 dpf or even smaller, preferably about 0.5 dpf or more, and most preferably of about 0.7 dpf or more, and can have deniers as high as about 10 dpf, or higher, preferably have deniers up to about 7 dpf, and more preferably up to about 5 dpf.

The yarns of this invention can have deniers as lows as about 20 or even smaller, preferably about 30 or more, and most preferably of about 50 or more, and can have deniers as high as about 300, or higher, preferably have deniers up to about 200, and more preferably up to about 150.

Non-round cross-section yarns having cross-sections meeting the above equation include those cross-sections described in the art as "octa-lobal", "sunburst" (also known as "sol"), "scalloped oval", "tri-lobal", "tetra-channel" (also known as "quatra-channel"), "scalloped ribbon", "ribbon", "starburst", etc.

As shown in FIG. 1, molten streams 20 of poly (trimethylene terephthalate) polymer are extruded through orifices in spinneret 22 downwardly into quench zone 24 supplied with radially or transversely directed quenching air. The temperature of molten streams 20 is controlled by the spin block temperature, which is known as the spinning temperature. Further, the cross-section and quantity of orifices in spinneret 22 may be varied depending upon the desired filament size and the number of filaments in the multifilament yarn according to conventional methods such as disclosed in U.S. Pat. Nos. 4,385,886, 4,850,847 and 4,956,237. In the present invention, the cross-section used is also considered with regard to the desired spinning speed. That is, to make direct-use spun yarns, the cross-section satisfies equations (I) and (II) if the desired spinning speed is less than 4500 mpm. Further, the spinning temperature is between about 255° C. and about 275° C. to make the direct-use spun yarns of the present invention. Preferably, the spinning temperature is between about 260° C. and about 270° C., and most preferably, the spinning temperature is maintained at about 265° C.

Streams 20 solidify into filaments 26 at some distance below the spinneret within the quench zone. Filaments 26 are converged to form multifilament yarn 28. A conventional spin-finish is applied to yarn 28 through a metered application or by a roll application such as finish roll 32 . Yarn 28 next passes in partial wraps about godets 34 and and 36 is wound on package 38. The filaments may be interlaced if desired, as by pneumatic tangle chamber 40.

The direct-use yarns are spun from a polyester polymer wherein said polymer comprises at least 85 mole % poly (trimethylene terephthalate) wherein at least 85 mole % of repeating units consist of trimethylene units, and wherein said polymer has an intrinsic viscosity ("IV") of at least about 0.70 dl/g. The poly(trimethylene terephthalate) preferably has an IV of at least about 0.8 dl/g, more preferably at least about 0.9 dl/g, and most preferably, at least about 1 dl/g. Intrinsic viscosity is preferably no more than about 1.5 dl/g, more preferably no more than about 1.2 dl/g. The intrinsic viscosity is measured in 50/50 weight percent methylene chloride/triflouroacetic acid following ASTM D 4603-96.

The polytrimethylene terephthalate of this invention may contain other repeating units, typically in the range of about 0.5–about 15 mole %. Examples of other monomers that can be used to prepare 3GT are linear, cyclic, and branched aliphatic dicarboxylic acids having 4–12 carbon atoms (for example butanedioic acid, pentanedioic acid, hexanedioic acid, dodecanedioic acid, and 1,4-cyclo-hexanedicarboxylic acid); aromatic dicarboxylic acids other than terephthalic acid and having 8–12 carbon atoms (for example isophthalic acid and 2,6-naphthalenedicarboxylic acid); linear, cyclic, and branched aliphatic diols having 2–8 carbon atoms (for example ethanediol, 1,2-propanediol, 1,4-butanediol, 3-methyl-1,5-pentanediol, 2,2-dimethyl-1,3-propanediol, 2-methyl-1,3-propanediol, and 1,4-cyclohexanediol); and aliphatic and aromatic ether glycols having 4–10 carbon atoms (for example, hydroquinone bis(2-hydroxyethyl) ether, or a poly(ethylene ether) glycol having a molecular weight below about 460, including diethyleneether glycol). Isophthalic acid, pentanedioic acid, hexanedioic acid, and 1,4-butanediol are preferred because they are readily commercially available and inexpensive. Preferred are polytrimethylene terephthalates that do not contain such other units, or that only contain minor amounts thereof.

The copolyester(s) can contain minor amounts of other comonomers, and such comonomers are usually selected so that they do not have a significant adverse affect on the amount of fiber crimp (in the case of a spontaneously crimpable polyester bicomponent fibers) or on other properties. Such other comonomers include 5-sodium-sulfoisophthalate, for example, at a level in the range of about 0.2–5 mole %. Very small amounts of trifunctional comonomers, for example trimellitic acid, can be incorporated for viscosity control and branching effect.

The polytrimethylene terephthalate may, if desired, contain other additives, e.g., delusterants, viscosity boosters, optical brighteners, toning pigments, and antioxidants. Delusterants, such as the preferred $TiO_2$, can be present in an amount of 0–3%, by weight of the polyester.

Polytrimethylene terephthalates can be manufactured by the processes described in U.S. Pat. Nos. 5,015,789, 5,276,201, 5,284,979, 5,334,778, 5,364,984, 5,364,987, 5,391,263, 5,434,239, 5,510454, 5,504,122, 5,532,333, 5,532,404, 5,540,868, 5,633,018, 5,633,362, 5,677,415, 5,686,276, 5,710,315, 5,714,262, 5,730,913, 5,763,104, 5,774,074, 5,786,443, 5,811,496, 5,821,092, 5,830,982, 5,840,957, 5,856,423, 5,962,745 and 5,990265, EP 998 440, WO 00/14041 and 98/57913, H. L. Traub, "Synthese und textilchemische Eigenschaften des Poly-Trimethyleneterephthalats", Dissertation Universitat Stuttgart (1994), S. Schauhoff, "New Developments in the Production of Polytrimethylene Terephthalate (PTT)", Man-Made Fiber Year Book (September 1996), and U.S. patent application Ser. Nos. 09/016,444, 09/273,288, 09/291,960, 09/346,148, 09/382,970, 09/382,998, 09/500,340, 09/501,700, 09/502,322, 09/502,642, 09/503,599, 09/505,785, 09/644,005, 09/644,007 and 09/644,008, all of which are incorporated herein by reference. Polytrimethylene terephthalates useful as the polyester of this invention are commercially available from E.I. du Pont de Nemours and Company, Wilmington, Del. under the trademark Sorona.

Measurements discussed herein are reported using conventional U.S. textile units, including denier. The dtex equivalents for denier are provided in parentheses after the actual measured values. Similarly, tenacity and modulus measurements were measured and reported in grams per denier ("gpd") with the equivalent dN/tex value in parentheses.

Test Methods

The physical properties of the partially oriented poly (trimethylene terephthalate) yarns reported in the following examples were measured using an Instron Corp. tensile tester, model no. 1122. More specifically, elongation to break, EB, and tenacity were measured according to ASTM D-2256.

Boil Off Shrinkage ("BOS") was determined according to ASTM D 2259 as follows: a weight was suspended from a length of yarn to produce a 0.2 g/d (0.18 dN/tex) load on the yarn, and its length, was measured $L_1$. The weight was then removed and the yarn was immersed in boiling water for 30 minutes. The yarn was then removed from the boiling water, centrifuged for about a minute and allowed to cool for about 5 minutes. The cooled yarn was then loaded with the same weight as before. The new length of the yarn, $L_2$, was recorded. The percent shrinkage was then calculated according to equation (III), below.:

$$\text{Shrinkage (\%)} = \frac{L_1 - L_2}{L_1} \times 100 \quad \text{(III)}$$

Dry Heat Shrinkage ("DHS") was determined according to ASTM D 2259 substantially as described above for BOS. $L_1$ was measured as described, however, instead of being immersed in boiling water, the yarn was placed in an oven at about 160° C. After about 30 minutes, the yarn was removed from the oven and allowed to cool for about 15 minutes before $L_2$ was measured. The percent shrinkage was then calculated according to equation (III), above.

EXAMPLES

Polymer Preparation

Although the present invention is not dependent upon the specific process used to prepare the polymer, the process used to prepare the polymer used in Comparative Example A is described below for completeness.

Polymer Preparation 1

Poly(trimethylene terephthalate) polymer was prepared using batch processing from dimethylterephthalate and 1,3-propanediol. A 40 lb (18 kg) horizontal autoclave with an agitator, vacuum jets and a monomer distillation still located above the clave portion of the autoclave was used. The monomer still was charged with 40 lb (18 kg) of dimethyl terephthalate and 33 lb (15 kg) of 1,3-propanediol. Sufficient lanthanum acetate catalyst was added to obtain 250 parts per million ("ppm") lanthanum in the polymer. Parts per million is equal to micrograms per gram. In addition, tetraisopropyl titanate polymerization catalyst was added to the monomer to obtain 30 ppm titanium in the polymer. The temperature of the still was gradually raised to 245° C. and approximately 13.5 lb (6.2 kg) of methanol distillate were recovered.

An amount of phosphoric acid in 1,3-propanediol solution to obtain about 160 ppm phosphorous in the polymer was added to the clave. The ingredients were agitated and well mixed and polymerized by increasing the temperature to 245° C., reducing pressure to less than 3 millimeters of mercury (less than 400 Pa) and agitating for a period of four to eight hours. With polymer molecular weight at the desired level, polymer was extruded through a ribbon or strand die, quenched, and cut into a flake or pellet size suitable for remelt extrusion or solid state polymerizing. Polymer intrinsic viscosity ("IV") in the range of 0.88 dl/g was produced by this method.

The polymer made by this process (no $TiO_2$, 0.88 dl/g) was used in Comparative Samples A-1–A-6.

Polymer Preparation 2

Poly(trimethylene terephthalate) polymer for use in Examples I–II was prepared from terephthalic acid and 1,3-propanediol using a two vessel process utilizing an esterification vessel ("reactor") and a polycondensation vessel ("clave"), both of jacketed, agitated, deep pool design. 428 lb (194 kg) of 1,3-propanediol and 550 lb (250 kg) of terephthalic acid were charged to the reactor. Esterification catalyst (monobutyl tin oxide at a level of 90 ppm Sn (tin)) was added to the reactor to speed the esterification when desired. The reactor slurry was agitated and heated at atmospheric pressure to 210° C. and maintained while reaction water was removed and the esterification was completed. At this time the temperature was increased to 235° C., a small amount of 1,3-propanediol was removed and the contents of the reactor were transferred to the clave.

With the transfer of reactor contents, the clave agitator was started and 91 grams of tetraisopropyl titanate was added as a polycondensation catalyst. $TiO_2$ was added to make a delustered polymer by adding a 20 percent by weight ("wt. %") slurry of titanium dioxide ($TiO_2$) in 1,3-propanediol solution to the clave in an amount to give 0.3 wt. % in polymer. The process temperature was increased to 255° C. and the pressure was reduced to 1 mm Hg (133 Pa). Excess glycol was removed as rapidly as the process would allow. Agitator speed and power consumption were used to track molecular weight build. When the desired melt viscosity and molecular weight were attained, clave pressure was raised to 150 psig (1034 kPa gauge) and clave contents were extruded to a cutter for pelletization.

Comparative Example A

In this comparative example, several poly(trimethylene terephthalate) yarns having round cross-section were spun from polymer prepared as described above in Polymer Preparation 1 and having an IV of 0.88. Each yarn was spun under identical conditions, except that the spinning speed was varied, as shown in Table I. The spinning conditions used in this comparative example are shown in Table I in order of increasing spinning speed as items A-1 through A-6. The partially to fully oriented yarns were spun using a remelt single screw extrusion process and a polyester fiber melt-spinning (S-wrap) technology into partially or fully oriented filaments of round cross-section by extruding through orifices (of about 0.38 mm diameter) of a spinneret. The spin block was maintained at a temperature as required to give a polymer temperature of approximately 267° C. The filamentary streams leaving the spinneret were quenched with air at 21° C., collected into bundles of 34 filaments, approximately 0.35 wt. % of a spin finish was applied, and the filaments were interlaced and collected as 34-filament yarns. Table I summarizes the spinning conditions used.

Table II shows the physical properties of the partially oriented yarn ("POY") (A-1 to A-4) and fully oriented yarn (A-5 and A-6) produced in this comparative example. As shown in Table II, as spinning speed increases, the boil off shrinkage of the partially oriented yarn decreases. Thus, when using partially oriented filaments having a round cross-section, the resulting partially oriented yarn is not suitable for direct-use purposes until the spinning speeds are greater than 5000 mpm and the yarn is termed fully oriented. Because the filaments used in the present example are round, the ratio of the actual cross-sectional area to the maximum cross-sectional area is 1.0.

Example I

This example shows that when the poly(trimethylene terephthalate) yarn filament has a non-round cross-section, a direct-use yarn can be produced at spinning speeds lower than 4500 mpm. The filaments were spun with a sunburst cross-section from polymer prepared as described above in Polymer Preparation 2, having an IV of 0.88. A remelt single screw extrusion process and polyester fiber melt-spinning (S-wrap) technology were used. The polymer was extruded through orifices of a spinneret and the spin block was maintained at a temperature as required to give a polymer temperature of approximately 270° C. The filamentary streams leaving the spinneret were quenched with air at 21° C., collected into bundles of 50 filaments, approximately 0.50 wt. % of a spin finish was applied, and the filaments were interlaced and collected at about 4020 mpm as a 50-filament yarn. The resulting spun yarn can be used without further drawing to give apparel fabric with soft hand and low sunlight glitter. The spinning conditions are provided in Table I and the yarn properties are provided in Table II. As shown in Table II, the fully oriented yarn of this example is suitable as a direct-use yarn because boil off shrinkage is less than 15%. Because the fully oriented yarn filaments have a non-round cross-section which satisfies the above equation I, a direct-use yarn was made using a spinning speed of just over 4000 mpm.

Figure 6:
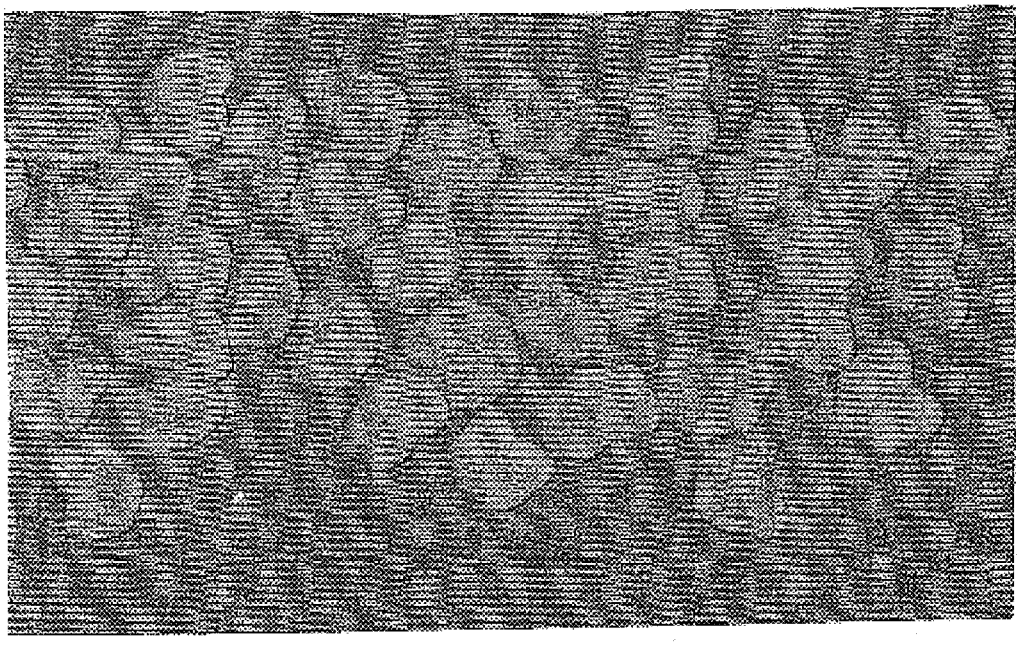
FIG. 6 is a micrograph (750× magnification) of filaments having a sunburst cross-section prepared as described in Example I.

FIG. 6 is a photomicrograph made using a Zeiss Axioplan 2 optical microscope at a image magnification of 750×. It shows the sunburst cross-sections of filaments made according to the process of this example.

Example II

This example shows that a direct-use yarn having filaments of varying cross-sections may be spun at spinning speeds less than 4500 mpm. In this example, poly (trimethylene terephthalate) yarns were spun from polymer prepared as described above in Polymer Preparation 2 having an IV of 0.88 using a remelt single screw extrusion process and polyester fiber melt-spinning (S-wrap) technology. Half of the resulting filaments had an octalobal cross-section and half had a sunburst cross-section. The polymer was extruded through orifices of a spinneret maintained at a temperature such as required to give a polymer temperature of approximately 265° C. The filamentary streams leaving the spinneret were quenched with air at 21° C., collected into bundles of 50 filaments, approximately 0.35 wt. % of a spin finish was applied, and the filaments were interlaced and collected at about 4020 mpm as a 50-filament yarn. The resulting yarn can be used without further drawing to give apparel fabric with soft hand and low sunlight glitter. As in Example I, because the yarn filaments have a non-round cross-section which satisfies equation I, a direct-use yarn was made using a spinning speed of just over 4000 mpm.

The properties for the direct-use yarns of the present invention prepared in Examples I and II are provided in Table II.

Example III

Figure 5:
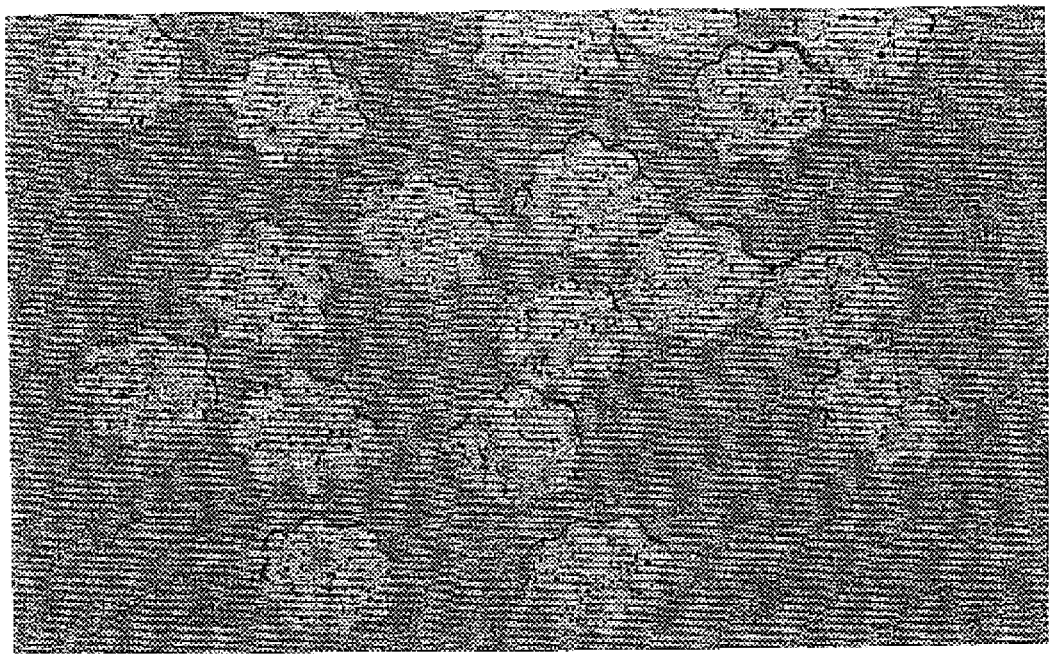
FIG. 5 is a micrograph (750× magnification) of filaments having an octa-lobal cross-section prepared as described in Example III.

This example is submitted to show that octa-lobal cross-section filaments satisfy the conditions of equation (I). FIG. 5 is a photomicrograph made using a Zeiss Axioplan 2 optical microscope at a image magnification of 750× and was used to measure $A_1$ and $A_2$.

TABLE I

SPINNING CONDITIONS

| Ex. | Cross-section | Orifice Dia., mm | Polymer Temp, ° C. | # of Filaments | Spin Finish, wt. % | Feed Roll Speed, mpm | Winding Speed, mpm |
|---|---|---|---|---|---|---|---|
| A-1 | Round | 0.38 | 267 | 34 | 0.33 | 3200 | 3164 |
| A-2 | Round | 0.38 | 267 | 34 | 0.33 | 3658 | 3639 |
| A-3 | Round | 0.38 | 267 | 34 | 0.33 | 4115 | 4096 |
| A-4 | Round | 0.38 | 267 | 34 | 0.33 | 4572 | 4545 |
| A-5 | Round | 0.38 | 267 | 34 | 0.33 | 5029 | 5000 |
| A-6 | Round | 0.38 | 267 | 34 | 0.33 | 5486 | 5422 |
| I | Sunburst | — | 270 | 50 | 0.50 | 4114 | 4020 |
| II | Octalobal/ Sunburst | — | 265 | 50 | 0.35 | 4115 | 4023 |
| III | Octalobal | — | — | — | — | — | — |

TABLE II

YARN PROPERTIES

| Ex. | $E_B$, % | Denier (dtex) | Denier Per Filament (dtex) | Tenacity, g/d (dN/tex) | Modulus, g/d (dN/tex) | BOS, % | DHS, % | $A_1/A_2$ |
|---|---|---|---|---|---|---|---|---|
| A-1 | 80 | 112(124) | 3.28(3.64) | 2.47(2.18) | 18.9(16.7) | 41 | — | 1.0 |
| A-2 | 69 | 98(109) | 2.87(3.19) | 2.73(2.41) | 20.1(17.7) | 36 | — | 1.0 |
| A-3 | 64 | 87(97) | 2.57(2.86) | 2.90(2.56) | 21.1(18.6) | 24 | — | 1.0 |
| A-4 | 58 | 82(91) | 2.42(2.69) | 2.95(2.6) | 22.1(19.7) | 16 | — | 1.0 |
| A-5 | 59 | 75(83) | 2.21(2.46) | 2.92(2.58) | 21.4(18.9) | 12 | — | 1.0 |
| A-6 | 58 | 61(68) | 1.79(1.99) | 3.46(3.05) | 25.8(22.8) | 9 | — | 1.0 |
| I | 71 | 155(172) | 3.09(3.43) | 2.81(2.48) | 22.7(20.0) | 10 | 9 | 0.87* |
| II | 69 | 153(170) | 3.06(3.40) | 2.59(2.29) | 23.2(20.5) | 12 | 10 | — |
| III | — | — | — | — | — | — | — | 0.80* |

*Average measured using cross sections photomicrographed using a Zeiss Axioplan 2 optical microscope at a image magnification of 750X.

Example IV

Figure 2:
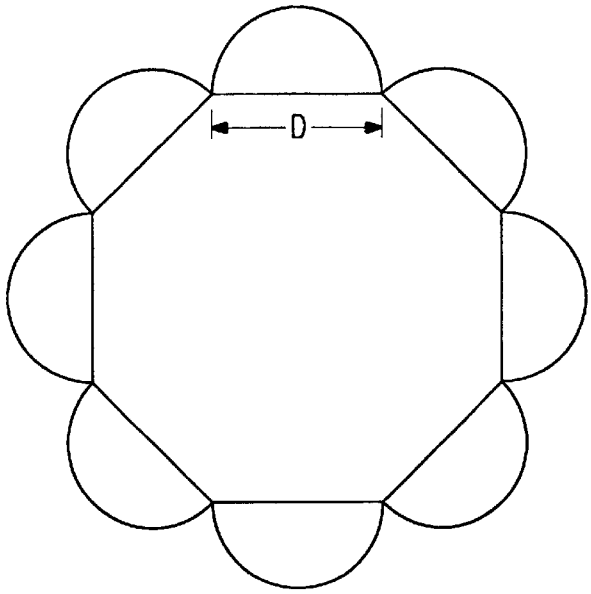
FIG. 2 is a schematic diagram of a hypothetical filament having an octalobal cross-section.
Figure 3:
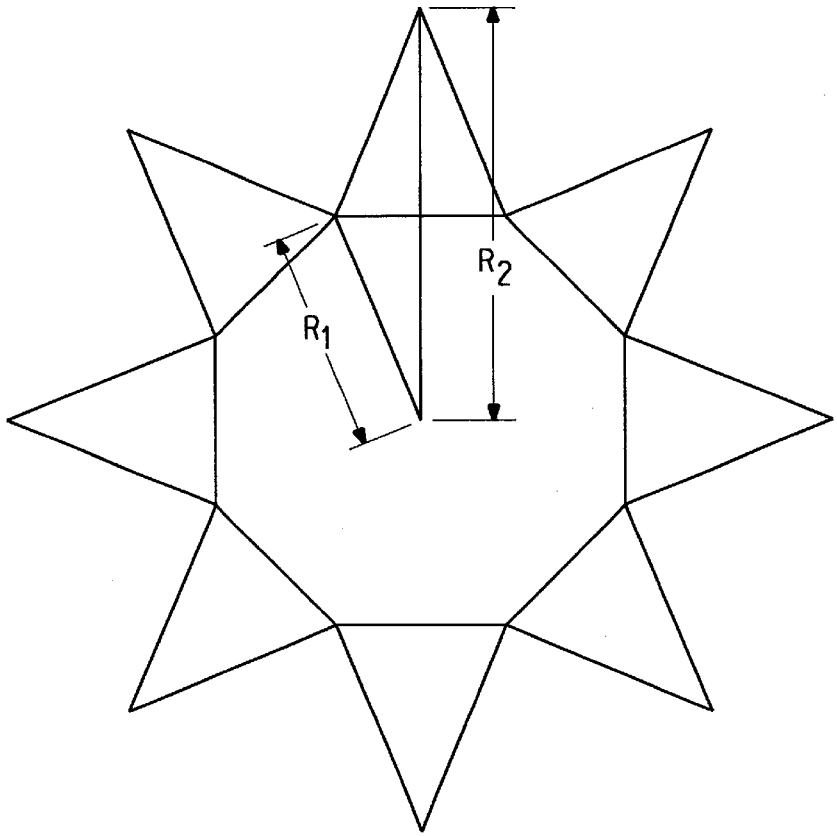
FIG. 3 is a schematic diagram of another hypothetical filament having an octalobal cross-section.
Figure 4:
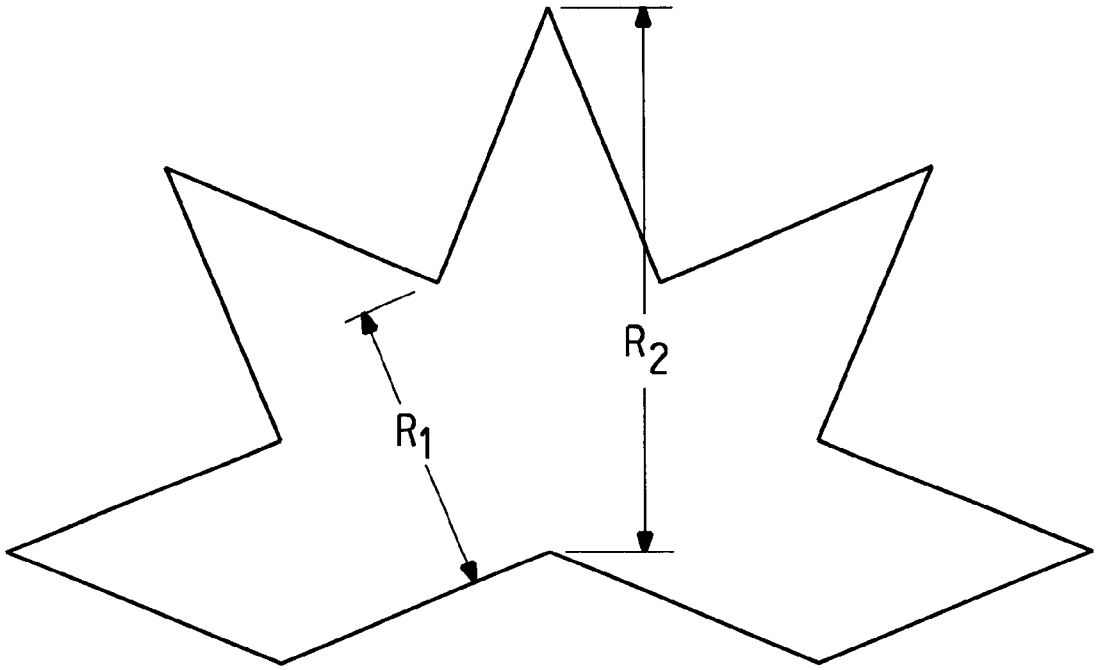
FIG. 4 is a schematic diagram of a hypothetical filament having a sunburst cross-section.

This example provides a plurality of filaments having "idealized" non-round cross-sections. The cross-sections are said to be idealized because, as shown in FIGS. 2–4, the shape of the filaments have been conformed to geometric shapes for which the perimeters and areas can be easily calculated using elementary geometry and trigonometry. Filaments having the same general non-round cross-sections as presented in this example are made from poly (trimethylene terephthalate) using the spinning process as described in Example II and extruding through orifices of the corresponding shape.

Smooth Octalobal Cross-section

The filament cross-section shown in FIG. 2 represents an idealized smooth octalobal cross-section. As shown in FIG. 2, an idealized smooth octalobal cross-section is essentially an octagonal shape, wherein each side has a convex semi-circular face. The perimeter of the filament, $P_1$, is given by:

$$P_1=4\pi D$$

The cross-sectional area of the filament, $A_1$, is given by:

$$A_1=D^2(\pi+2\cot(22.5))=7.97\,D^2$$

Given the perimeter, $P_1$, the maximum cross-sectional area, $A_2$, is:

$$A_2\times 4\pi D^2=12.5D^2$$

The ratio of actual filament area to maximum area is given by:

$$A_1/A_2=0.64$$

Thus, according to condition (I), a filament having such an idealized octalobal cross-section is non-round and is spun into a direct-use yarn according to the present invention.

Pointed Octalobal Cross-section

The filament cross-section shown in FIG. 3 represents an idealized pointed octalobal cross-section. As shown in FIG. 3, an idealized pointed octalobal cross-section is essentially an octagonal shape, wherein each side comprises a triangular peak. The perimeter of the filament, $P_1$, is given by:

$$P_1=16\sqrt{R_1^2+R_2^2-2R_1R_2\cos(22.5°)}$$

The cross-sectional area of the filament, $A_1$, is given by:

$$A_1 = 16\times\frac{1}{2}\times R_1R_2\sin(22.5°) = 8R_1R_2\sin(22.5°)$$

Given the perimeter, $P_1$, the maximum cross-sectional area, $A_2$, is:

$$A_2 = \frac{64(R_1^2 + R_2^2 - 2R_1R_2\cos(22.5°))}{\pi}$$

The ratio of actual filament area to maximum area is given by:

$$A_1/A_2 = \frac{\pi R_1 R_2 \sin(22.5°)}{8(R_1^2 + R_2^2 - 2R_1R_2\cos(22.5°))}$$

The ratio $R_2/R_1$ is known as the modification ratio ("mod ratio"). The mod ratio can be adjusted to produce a direct-use yarn according to the present invention. For example, for the idealized filament shown in FIG. 2, a mod ratio of 1.16, i.e., $R_2 \times 1.16\ R_1$, produces a direct-use yarn satisfying condition (I) above:

$$A_1/A_2 = 0.86$$

However, a mod ratio of 1.05 does not result in a "non-round" cross-section:

$$A_1/A_2 = 0.97$$

Sunburst Cross-section

The filament cross-section shown in FIG. 4 represents an idealized sunburst cross-section. As shown in FIG. 4, an idealized sunburst cross-section is essentially a pointed octalobal cross-section with three lobes removed. The perimeter of the filament, $P_1$, is given by:

$$P_1 = 5/8 \times 16(R_1^2 + R_2^2 - 2R_1R_2\cos(22.5°))^{1/2} + 2R_1$$
$$= 10(R_1^2 + R_2^2 - 2R_1R_2\cos(22.5°))^{1/2} + 2R_1$$

The cross-sectional area of the filament, $A_1$, is given by $$A_1 = \tfrac{5}{8} \times 8\ R_1R_2\ \sin(22.5°) = \tfrac{5}{8}(8)(0.38)R_1R_2 = 1.9R_1R_2$$

as the area, $A_1$, is $\tfrac{5}{8}^{th}$'s the area of the "pointed, octalobal" cross-section. Given the perimeter, $P_1$, the maximum cross-sectional area, $A_2$, is given by $$A_2 = \frac{\pi \times \text{diameter of maximum circle squared}}{4},$$

where the diameter of the maximum circle is $P_1/\pi$ $$A_2 = \frac{\pi \times P_1^2}{4\pi^2} = \frac{P_1^2}{4\pi}$$
$$= \frac{\{10(R_1^2 + R_2^2 - 2R_1R_2\cos(22.5°))^{1/2} + 2R_1\}^2}{4\pi}$$

If $R_2 = 1.16R_1$, then $A_1/A_2 = 0.66$.

If $R_2 = 1.3R_1$, then $A_1/A_2 = 0.57$.

The foregoing disclosure of embodiments of the present invention has been presented for purposes of illustration and description. It is not intended to be exhaustive or to limit the invention to the precise forms disclosed. Many variations and modifications of the embodiments described herein will be obvious to one of ordinary skill in the art in light of the above disclosure.

What we claim is:

1. A process for spinning a direct-use yarn, comprising extruding a polyester polymer through a spinneret to form molten streams of polymer at a spinning speed less than 4500 mpm and a temperature between about 255° C. and about 275° C., wherein said polymer comprises at least 85 mole % poly(trimethylene terephthalate) wherein at least 85 mole % of repeating units consist of trimethylene units, and wherein said polymer has an intrinsic viscosity of at least 0.70 dl/g, solidifying said molten streams to form non-round filaments, and converging said filaments to form said yarn.

2. The process of claim 1, wherein the spinning temperature is about 260° C.–about 270° C.

3. The process of claim 1, wherein the direct-use yarn is characterized by a boil off shrinkage of less than 15%.

4. The process of claim 1 wherein an individual filament in the plurality of non-round filament is characterized by:

a) $0.5 \le \frac{A_1}{A_2} \le 0.95$; and b) $A_2 = \frac{P_1^2}{4\pi}$, wherein $A_1$ is an area of a cross-section of the individual filament, $P_1$ is a perimeter of said cross-section of the individual filament, and $A_2$ is a maximum area of a cross-section having a perimeter $P_1$.

5. The process of claim 4 wherein $0.6 \leqq A_1/A_2 \leqq 0.95$.

6. The process of claim 4 wherein at least 65% of the filaments of the yarn meet the conditions.

7. The process of claim 4 wherein at least 70% of the filaments of the yarn meet the conditions.

8. The process of claim 4 wherein at least 90% of the filaments of the yarn meet the conditions.

9. The process of claim 4 wherein on average the individual filaments in the yarn meet the conditions.

10. The process of claim 4 wherein the yarn filaments have deniers of 0.35 dpf–10 dpf.

11. The process of claim 4 wherein the yarn has a denier of 20–300.

12. The process of claim 4 wherein the poly(trimethylene terephthalate) has an IV of 0.8 dl/g–1.5 dl/g.

13. The process of claim 1 wherein the yarn is not drawn or annealed.

14. The process of claim 1 wherein the non-round cross-section is selected from the group consisting of octa-lobal, scalloped oval and tetra-channel.

15. The process of preparing a fabric comprising:

(c) spinning a direct-use yarn as claimed in claim 1, and (d) weaving or knitting the yarn into a fabric.

16. The process of claim 15 wherein the yarn is fully oriented during spinning and is not drawn or annealed to orient the yarn after spinning.

* * * * *